United States Patent [19]

Bartley et al.

[11] 3,932,242

[45] Jan. 13, 1976

[54] SOLID PROPELLANT WITH BUTYL RUBBER BINDER

[76] Inventors: Charles E. Bartley, 6520 E. Exeter Blvd., Scottsdale, Ariz. 85251; Lawrence R. Settlemire, 2489 Ocean St., Carlsbad, Calif. 92008

[22] Filed: May 8, 1961

[21] Appl. No.: 108,672

Related U.S. Application Data

[63] Continuation-in-part of Ser. No. 697,789, Nov. 21, 1957, abandoned, which is a continuation-in-part of Ser. No. 355,148, May 14, 1953, abandoned, and a continuation-in-part of Ser. No. 692,147, Aug. 21, 1946, abandoned.

[52] U.S. Cl. ..... 149/19.9; 149/19.91; 149/60

[51] Int. Cl. ..... C06d 5/06

[58] Field of Search ..... 149/19, 19.9, 60, 19.91

[56] References Cited

UNITED STATES PATENTS

| | | | |
|---|---|---|---|
| 3,018,201 | 1/1962 | Downard | 149/19.9 |
| 3,249,475 | 5/1966 | Jorczak et al. | 149/19.9 |

*Primary Examiner*—Benjamin R. Padgett
*Assistant Examiner*—E. A. Miller

EXEMPLARY CLAIM

1. A solid propellant charge for rocket motors consisting essentially of a formed vulcanized mixture of rubbery isobutylene-isoprene copolymer fuel binder in the proportion of 10–20% by weight and a solid inorganic strong oxidizing salt in the proportion of 80–90% by weight.

6 Claims, No Drawings

SOLID PROPELLANT WITH BUTYL RUBBER BINDER

The present application is a continuation-in-part of our co-pending application Ser. No. 697,789 filed Nov. 21, 1957 now abandoned, which in turn is a continuation-in-part of our earlier application Serial No. 692,147, filed Aug. 21, 1946, now abandoned, and our co-pending application Ser. No. 355,148, filed May 14, 1953, now abandoned.

The present invention relates to improvements in solid propellant charges for rocket motors or the like and is concerned specifically with the novel composition of butyl rubber or a rubbery isobutylene-isoprene copolymer fuel binder in admixture with an oxidizer.

The principal object of the invention is to provide a superior solid propellant composition having the following properties: maximum storage stability, minimum cost and simplicity of manufacture, constancy of physical properties over a wide range of temperatures, appropriate elasticity and elongation, negligible shrinkage, maximum thermodynamic properties for heat production and physical ability to incorporate large quantities of granular material such as oxidizers and still maintain ability to bind the resulting mass into a solid unit of adequate strength. We have found that butyl rubber or, more particularly, rubbery isobutylene-isoprene copolymer as a fuel binder for the charge meets all of these requirements in contrast with prior art fuel materials all of which we have found to be deficient in some if not all of the foregoing respects.

Our invention contemplates the admixture of the rubbery isobutylene-isoprene copolymer in a minor proportion with any solid oxidizer material in a major proportion. Excellent results have been obtained with solid inorganic strong oxidizing salts such as ammonium nitrate, potassium perchlorate and ammonium perchlorate and various mixtures thereof. Ammonium nitrate is particularly effective.

The particular proportions usually are 5–25% fuel binder by weight and 75–95% oxidizer by weight in most instances. However, in preferred embodiments of the invention, the proportions are 10–20% fuel binder by weight and 80–90% oxidizer by weight.

Various known additives such as plasticizers, vulcanizers, and accelerators may be used in the fuel binder-oxidizer mixture if desired. Also any suitable burning rate catalyst, ferric oxide for example, may optionally be added to the mixture.

The oxidizer is preferably uniformly dispersed in the rubbery isobutylene-isoprene copolymer by any suitable mixing operation such as by the use of mills or mixers ordinarily used in compounding conventional rubber products.

After the mixing operation, the resulting combustible material may be molded, extruded or laminated or otherwise formed into any desired shape or size and then fused or vulcanized into a solid mass to provide the solid propellant charge.

More particularly, our preferred self-combustible materials consist essentially of ammonium nitrate oxidizer, a burning rate catalyst, and a rubber or an elastomeric fuel binder(s) to which is added suitable plasticizers, vulcanizing agents, accelerating agents, etc. The resulting mixture is pressed, or extruded, or built up in layers, or formed by some physical means into a desired size and shape and then fused or vulcanized into one continuous mass.

Experimentation has indicated that our combustible materials should have the following ingredients in the approximate proportions indicated:

| | |
|---|---|
| Ammonium Nitrate Oxidizer | 70–90 per cent |
| Ferric Oxide Burning Rate Catalyst | ½–10 per cent |
| Fuel Binder | 5–25 per cent |
| Miscellaneous Burning Rate Catalyst | 0–10 per cent |
| Plasticizer | 0–10 per cent |
| Vulcanizer | 0–5 per cent |
| Accelerator | 0–5 per cent |
| Miscellaneous (anti-aging) (agents, etc.) | 0–5 per cent |

Now, mixtures of fuels and ammonium nitrate generally will not burn at all, or will burn too slowly for practical rocket propellant applications. Burning usually must be promoted by a catalyst, and we have found iron and/or iron oxides to be effective catalysts in our experiments. We believe this discovery to be significant because of the abundance of iron oxides, whereas the only other appreciably effective commonly used catalyst is ammonium dichromate which is scarce in the present economy.

We have found that natural or synthetic rubbers such as butadiene-acrylonitrile, butadiene-styrene, isobutylene-isoprene and chloroprene ("Neoprene" type), are adaptable for fuel binders. Such elastomeric "plastic" polymers as polyethylene and vinyl acetate appear to be feasible, also. The elastomeric type of fuel is emphasized to be a requisite when used with ammonium nitrate because of its ability to elongate to absorb the volume phase changes of the ammonium nitrate without cracking or fissuring. The rubber base combustibles which we have prepared have been cycled repeatedly from −50°F. to 140°F. without cracking and then have burned smoothly as predicted when used as rocket motor charges. The charges used in our initial experiments were 5 inches in diameter and 10 inches in length and were prepared by a molding process with non-combustible rubber coating so they burned from one end only (like a cigarette) in some tests. These charges burned radially in other tests after a one inch diameter hole was drilled concentric with the longitudinal axis of the original solid charge. Charges approximately 25 inches long and 9 inches in diameter, and with star shaped axial perforations, were prepared by plying (built up in layers from sheets); charges prepared by this method burned satisfactorily under pressure in rocket motors at temperatures over a range of −100°F. to 160°F. Our preparation methods indicated that any size or shape of charge could be made.

Any one of the described fuels is mixed with ammonium nitrate by pug mills, Bunbury Mixers, Beken Duplex Mixers, or differential roller mills such as used in compounding conventional rubber products. These methods of mixing are particularly significant because a large amount — up to about 90 per cent by weight — of the bulky ammonium nitrate can be uniformly dispersed into the rubber fuels to yield a product with enough potential energy to be applicable to rocket uses, an example being for assisted take-off of aircraft. To our knowledge, these methods of mixing have been the only ones which have been successful in providing a means for obtaining such high, evenly dispersed, loading of ammonium nitrate into fuels. The high oxidizer content provides smokeless burning for straight hydrocarbon fuels, the products of combustion being primarily CO, $H_2O$, $CO_2$ $N_2$, and $H_2$.

The plasticizers and other additives may be added during mixing to promote ease of processing, to control heat generated during subsequent vulcanization, and to control physical properties of the vulcanized product. In some formulations, the plasticizer and additives may substantially affect the burning properties of the combustible material. For example, the epoxy type of resin (one effective grade is sold as Epon 1062) has been used by us as a processing plasticizer, and has promoted the burning.

After the mixing operation, the combustible material can be put through the mill to obtain a sheet form which may be up to about ½ inch in thickness. Shapes, such as discs, rings, stars, or whatever are desirable, are cut from said sheet and stacked into a cylinder. The resulting cylinder is then placed into a mold which conforms approximately to the dimensions of the charge and a suitable cover is tightened to force the charge into full conformity to the mold. An extrusion process has also been used to accomplish the shaping and sizing of the material. A particularly easy and unique fabricating method has been to adhere one layer to another by using a very thin layer of adhesive so that the charge is bonded together without application of high molding or extrusion pressure; this plying method allows a simple inexpensive manner of fabricating almost any size and shape. For molding fabrication, the locked mold is then placed in an oven at about 200°F. until the charges vulcanizes into one piece. After vulcanization, the mold is removed to be cooled. The charge shrinks enough during the cooling to free itself readily from the mold. The resulting molded product is of high physical quality, possessing sufficient elongation to absorb the phase changes of ammonium nitrate as discussed previously.

In many instances it is desirable to restrict the burning of the molded charge to predetermined surfaces; for example, if it is desirable for the charge to burn like a cigarette, all surfaces of a solid cylinder must be inhibited with the exception of one end. This is readily accomplished with our combustible materials. After initially forming the charges, a layer of rubber containing no oxidizer is wrapped around the propellant and a disc of such rubber placed over one end. During the molding process the inhibitor layer vulcanizes to the charge. If an extrusion process is used, it is possible to extrude the inhibitor layer over the charge as it issues from the main extrusion die. For the charge which is plyed and bonded together by adhesive, an adhesive may be applied to the desired portions and then covered by tape to obtain the necessary heat insulation.

While our product is particularly applicable as a rocket propellant or for high pressure gas generation, experimentation has established the fact that our invention is suitable for use as a fuze. That is, when the material is formed into spagetti-like strands of given lengths it makes a very reliable fuze with a closely controlled burning time. For the fuzes, compounding oxidizers such as potassium perchlorate and ammonium perchlorate into the fuel in place of ammonium nitrate may be desirable for altering the basic burning rates.

Some particular compositions which we have prepared by the methods previously described, and tested as rocket propellant, are identified as follows:

1. Neoprene fuel base:

| | | Ingredients | Per Cent Ingredient by Weight | | | |
|---|---|---|---|---|---|---|
| | | Neoprene (chloroprene) | 14.48 | 14.48 | 14.48 | |
| | | Ammonium Nitrate | 72.38 | 76.18 | 78.09 | |
| | | Ferric Oxide | 7.62 | 3.81 | 1.90 | |
| | (1) | Cottonseed oil | 2.86 | 2.86 | 2.86 | |
| | (2) | Zinc Oxide | 0.76 | 0.76 | 0.76 | |
| | (3) | Magnesium Oxide | 0.57 | 0.57 | 0.57 | |
| | (4) | Phenyl-beta-napthyl-amine | 0.29 | 0.29 | 0.29 | |
| | (5) | Stearic Acid | 0.10 | 0.10 | 0.10 | |
| | (6) | Carbon Black | 0.95 | 0.95 | 0.95 | |
| | | Ammonium Dichromate | — | — | — | |
| Properties | | Specific wt., lbs/in³ | — | 0.057 | — | |
| | | Burning rate, in/sec, at 80°F. at 1000 lbs/sq.in. | 0.09 | 0.10 | 0.10 | 0.15 |
| | | at 500 lbs/sq.in. | 0.05 | 0.06 | 0.06 | |
| | | Specific Impulse lb sec./lb. at 1000 psi | 170 | 175 | 180 | 180 |

(1) plasticizer. (2) vulcanizing agent (3) vulcanizing accelerator.
(4) anti-oxidant. (5) processing aid. (6) reinforcing aid.

2. Fuel base of butadiene-styrene rubber

| | Ingredient | Per Cent Ingredient by Weight |
|---|---|---|
| | Butdiene-Styrene | 16.77 |
| | Ammonium Nitrate | 73.12 |
| | Ferric Oxide | 7.68 |
| (1) | 80% Mineral Oil, 15% sulfonated petroleum product, 5% n-butyl alcohol | 1.00 |
| (2) | Zinc Oxide | 0.50 |
| (3) | Powdered selenium | 0.13 |
| (4) | Tetramethylthiuram sulfide | 0.12 |
| (5) | Stearic Acid | 0.17 |
| (6) | Sulfur | 0.42 |

-continued

2. Fuel base of butadiene styrene rubber

| | Ingredient | Per Cent Ingredient by Weight |
|---|---|---|
| Properties | Specific wt., lbs/in³ | 0.055 |
| | Burning rate, in/sec, at 80°F. | |
| | at 1000 lbs/sq in. | 0.10 |
| | at 500 lbs/sq.in. | 0.07 |
| | Specific Impulse, lb sec/lb at 100 lbs/in² | 160 |

(1) Plasticizer. (2) Vulcanizing Agent. (3) Vulcanizing Agent.
(4) Vulcanizing Accelerator. (5) Processing Aid. (6) Vulcanizing Agent.

3. Fuel base of isobutylene-isoprene rubber

| | Ingredient | Per Cent Ingredient by Weight | | |
|---|---|---|---|---|
| | Isobutylene-isoprene rubber | 12.50 | 11.13 | 11.115 |
| | Ammonium Nitrate | 80.00 | 79.03 | 84.62 |
| | Ferric Oxide | 5.50 | 1.09 | 1.09 |
| (1) | Petrolatum | 0.36 | — | — |
| (1) | Dioctyl Azelate | — | 2.33 | 2.33 |
| (2) | Stearic Acid | 0.13 | 0.12 | 0.12 |
| (3) | Zinc Oxide | 0.63 | 0.60 | 0.50 |
| (4) | Carbon Black | 0.63 | — | — |
| (5) | Para-quinone-dioxime | — | 0.10 | 0.125 |
| (5) | Sulfur | 0.25 | — | — |
| | Ammonium dichromate | — | 5.59 | — |
| Properties | Specific wt., lbs/in³ | 0.056 | 0.057 | 0.058 |
| | Burning rate, in/sec at 80°F. | | | |
| | at 1500 lbs/sq.in. | 0.08 | — | — |
| | at 1000 lbs/sq.in. | 0.06 | 0.14 | 0.045 |
| | Specific Impulse lb sec/lb at 1000 lb/sq.in. | 175 | 200 | 210 |

(1) plasticizer. (2) processing aid. (3) vulcanizing agent.
(4) reinforcing aid. (5) vulcanizing agent.

Various changes and alternate arrangements may be made within the scope of the appended claims, in which it is our intention to claim all novelty inherent in the invention as broadly as the prior art permits.

We claim:

1. A solid propellant charge for rocket motors consisting essentially of a formed vulcanized mixture of rubbery isobutylene-isoprene copolymer fuel binder in the proportion of 10–20% by weight and a solid inorganic strong oxidizing salt in the proportion of 80–90% by weight.

2. The solid propellant charge of claim 1 wherein the oxidizer is ammonium nitrate.

3. A solid propellant charge for rocket motors consisting essentially of a formed vulcanized mixture of rubbery isobutylene-isoprene copolymer fuel binder in the proportion of 5–25% by weight and a solid inorganic strong oxidizing salt in the proportion of 75–95% by weight.

4. The solid propellant charge of claim 3 wherein the oxidizer is ammonium nitrate.

5. A solid propellant charge for rocket motors containing a formed vulcanized mixture of rubbery isobutylene-isoprene copolymer fuel binder in the proportion of 5–25% by weight with a solid inorganic strong oxidizing salt in the proportion of 70–90% by weight and ferric oxide as a burning rate catalyst in the proportion of ½–10% by weight.

6. A solid propellant charge for rocket motors containing a formed vulcanized mixture of rubbery isobutylene-isoprene copolymer fuel binder in the proportion of 5-25% by weight with an ammonium nitrate oxidizer in the proportion of 70–90% by weight and ferric oxide as a burning rate catalyst in the proportion of ½–10% by weight.

* * * * *